US009871280B2

(12) United States Patent
Yoshikawa

(10) Patent No.: US 9,871,280 B2
(45) Date of Patent: Jan. 16, 2018

(54) DIELECTRIC RESONATOR, DIELECTRIC FILTER, AND COMMUNICATION APPARATUS

(71) Applicant: KYOCERA Corporation, Kyoto-shi, Kyoto (JP)

(72) Inventor: Hiromichi Yoshikawa, Kyoto (JP)

(73) Assignee: Kyocera Corporation, Kyoto (JP)

( * ) Notice: Subject to any disclaimer, the term of this patent is extended or adjusted under 35 U.S.C. 154(b) by 72 days.

(21) Appl. No.: 15/100,416

(22) PCT Filed: Dec. 11, 2014

(86) PCT No.: PCT/JP2014/082853

§ 371 (c)(1),
(2) Date: May 31, 2016

(87) PCT Pub. No.: WO2015/087974

PCT Pub. Date: Jun. 18, 2015

(65) Prior Publication Data

US 2016/0308265 A1 Oct. 20, 2016

(30) Foreign Application Priority Data

Dec. 13, 2013 (JP) ..... 2013-258213

(51) Int. Cl.
*H01P 1/208* (2006.01)
*H01P 7/10* (2006.01)

(52) U.S. Cl.
CPC ..... *H01P 1/2086* (2013.01); *H01P 1/2084* (2013.01); *H01P 7/105* (2013.01)

(58) Field of Classification Search
CPC ..... H01P 7/10; H01P 7/105; H01P 1/2084; H01P 1/2086; H01P 1/208; H01P 1/2082
USPC ..... 333/219.1, 219, 227, 212, 209, 208, 202
See application file for complete search history.

(56) References Cited

U.S. PATENT DOCUMENTS 4,623,857 A * 11/1986 Nishikawa ..... H01P 1/2086 333/202
5,874,870 A * 2/1999 Nishiyama ..... H01P 1/2086 333/202
2006/0139127 A1* 6/2006 Wada ..... H01P 1/2086 333/202

FOREIGN PATENT DOCUMENTS

JP 01-057804 U 4/1989
JP 05-067905 A 3/1993
JP 05-167318 A 7/1993

OTHER PUBLICATIONS

International Search Report, PCT/JP2014/082853, dated Jan. 20, 2015, 1 pg.

* cited by examiner

*Primary Examiner* — Stephen E Jones
(74) *Attorney, Agent, or Firm* — Volpe and Koenig, P.C.

(57) ABSTRACT

A dielectric resonator which has a simple structure and is easy to manufacture, and a dielectric filter and a communication apparatus using the same are provided. In a dielectric resonator, a dielectric body includes a first portion having surfaces and a second portion having surfaces. A conductor surrounding the dielectric body includes inner surfaces facing the surfaces. A conductor is disposed between the surface and the inner surface. A conductor is disposed between the surface and the inner surface. The dielectric body includes a third portion which is not interposed between the conductors and a fourth portion which is not interposed between conductors.

6 Claims, 11 Drawing Sheets

DIELECTRIC RESONATOR, DIELECTRIC FILTER, AND COMMUNICATION APPARATUS

TECHNICAL FIELD

The present invention relates to a dielectric resonator, a dielectric filter, and a communication apparatus which have excellent electrical characteristics.

BACKGROUND ART

There have been known multi-mode dielectric resonators in which a shield case accommodates a dielectric body having a shape in which a plurality of columns cross each other (see, for example, Patent Literature 1).

CITATION LIST

Patent Literature

Patent Literature 1: Japanese Unexamined Patent Publication JP-A5-167318(1993)

SUMMARY OF INVENTION

Technical Problem

However, in the dielectric resonator of the related art which is proposed in Patent Literature 1, in a case where a triple mode resonator is manufactured, it is necessary to form a dielectric body having a shape in which three columns cross each other, and thus there is a problem in that it is difficult to manufacture the dielectric body due to its complex shape.

The invention is contrived in view of such a problem, and an object thereof is to provide a dielectric resonator which has a simple structure and is easy to manufacture, and a dielectric filter and a communication apparatus using the dielectric resonator.

Solution to Problem

According to one embodiment of the invention, a dielectric resonator includes a dielectric body; a first conductor; a second conductor; a third conductor; a fourth conductor; and a fifth conductor, the dielectric body including a first portion which has a first surface located at an end in a first direction of the first portion and a second surface located at an end in a second direction opposite to the first direction of the first portion, the first portion having a columnar shape, and a second portion which includes a third surface located at an end in a third direction perpendicular to the first direction of the second portion and a fourth surface located at an end in a fourth direction opposite to the third direction of the second portion, the second portion having a columnar shape, the first portion and the second portion crossing each other, the first conductor being disposed such that the dielectric body is housed in a cavity formed therein, the first conductor being disposed so as to surround the dielectric body leaving space therefrom, the first conductor having a first inner surface facing the first surface, a second inner surface facing the second surface, a third inner surface facing the third surface, and a fourth inner surface facing the fourth surface, the second conductor being disposed on the first surface, an end in the first direction of the second conductor being electrically connected to the first inner surface, the third conductor being disposed on the second surface, an end in the second direction of the third conductor being electrically connected to the second inner surface, the fourth conductor being disposed on the third surface, an end in the third direction of the fourth conductor being electrically connected to the third inner surface, the fifth conductor being disposed on the fourth surface, an end in the fourth direction of the fifth conductor being electrically connected to the fourth inner surface, the dielectric body including a third portion which is a portion of the first portion which is not interposed between the second conductor and the third conductor, and a fourth portion which is a portion of the second portion which is not interposed between the fourth conductor and the fifth conductor.

According to an embodiment of the invention, a dielectric filter includes the dielectric resonator, a tenth conductor, and an eleventh conductor, the tenth conductor being a linear conductor, and including a first end which is one end, and a second end which is the other end, the first end being connected to the second conductor or the third conductor, the second end being exposed to an outside through a first through hole provided in the first conductor, the tenth conductor being electromagnetically coupled to the first portion, the eleventh conductor being a linear conductor, and including a third end which is one end, and a fourth end which is the other end, the third end being connected to the fourth conductor or the fifth conductor, the fourth end being exposed to an outside through a second through hole provided in the first conductor, the eleventh conductor being electromagnetically coupled to the second portion.

According to an embodiment of the invention, a communication apparatus includes an antenna, a communication circuit, and the dielectric filter configured to connect the antenna with the communication circuit.

Advantageous Effects of Invention

According to a dielectric resonator of the invention, it is possible to obtain a dielectric resonator which has a simple structure and is easy to manufacture. According to a dielectric filter of the invention, it is possible to obtain the dielectric filter which has a simple structure and is easy to manufacture. According to a communication apparatus of the invention, it is possible to obtain the communication apparatus which is easy to manufacture.

DESCRIPTION OF EMBODIMENTS

Hereinafter, a dielectric resonator of the invention, and a dielectric filter and a communication apparatus using the dielectric resonator will be described in detail with reference to the accompanying drawings.

First Embodiment

Figure 1:
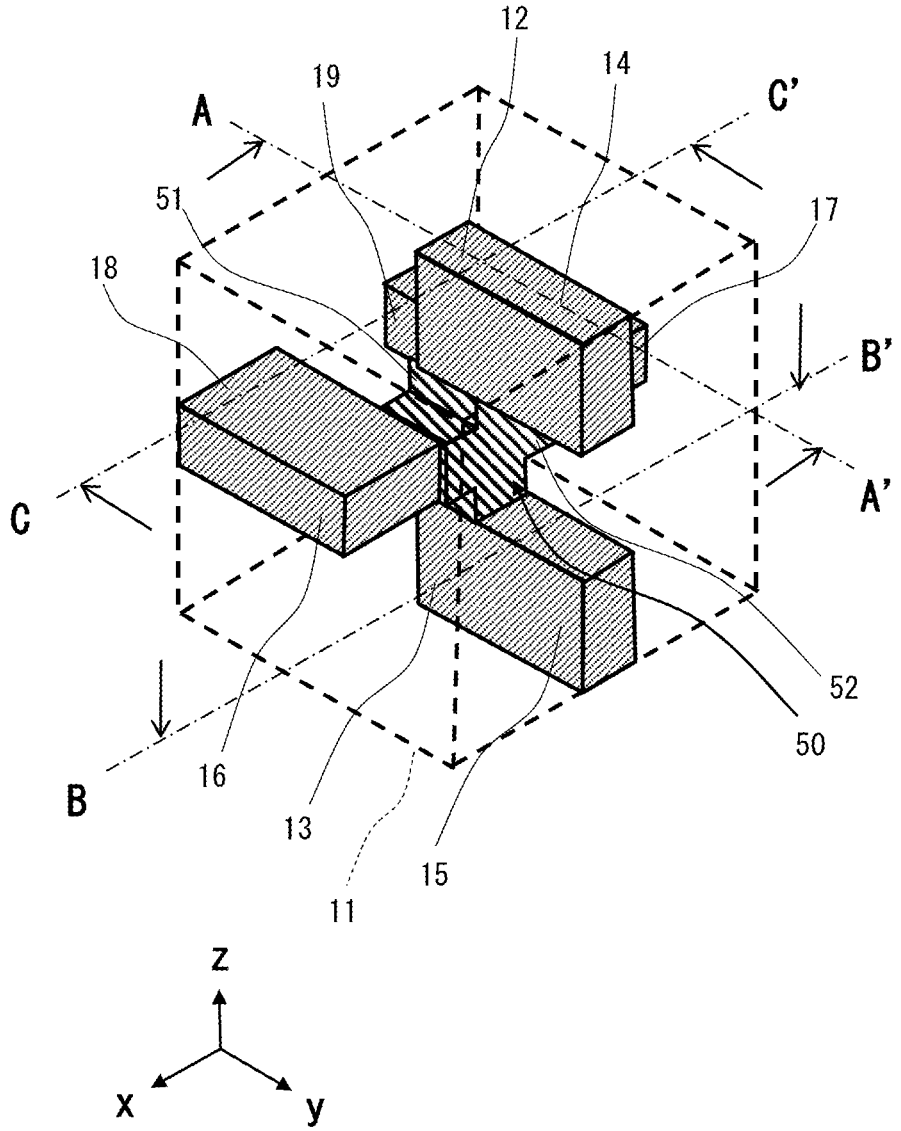
FIG. 1 is a schematic perspective view of a dielectric resonator according to a first embodiment of the invention.
Figure 2:
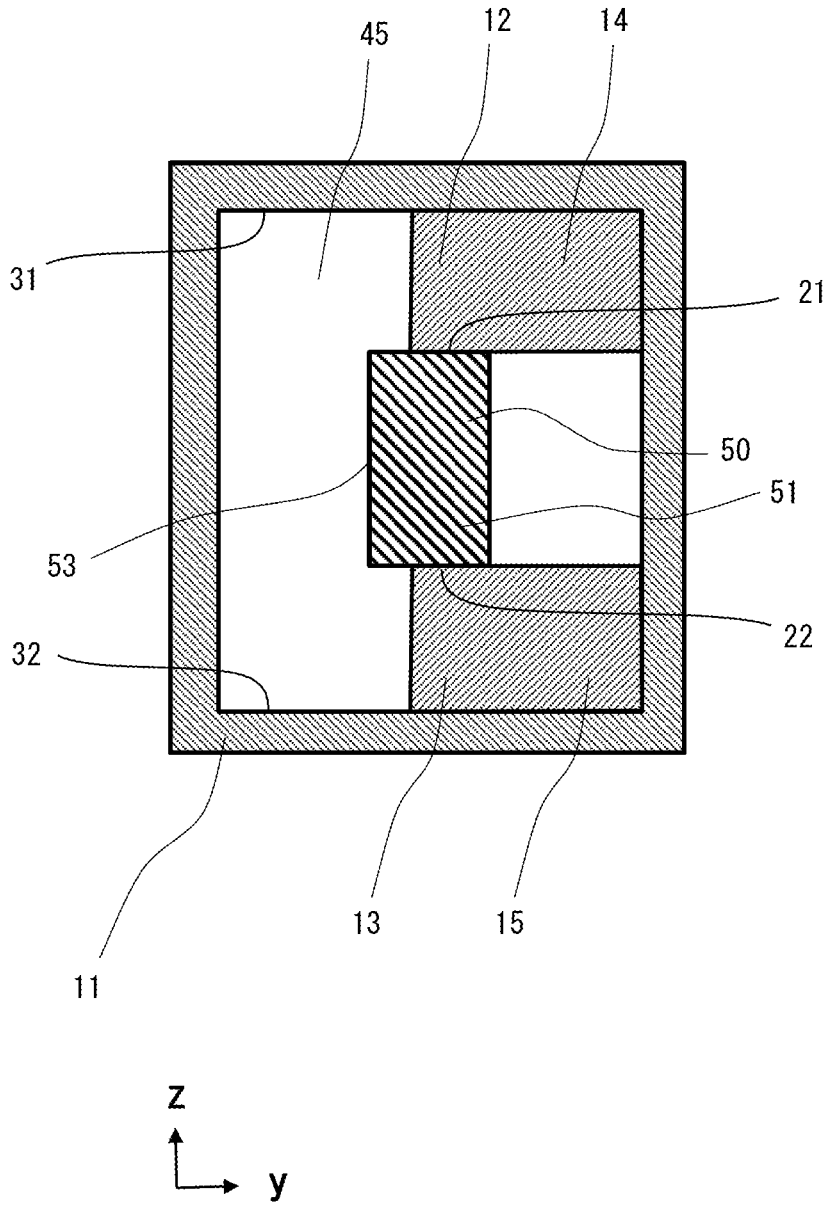
FIG. 2 is a cross-sectional view taken along the line A-A' of FIG. 1.
Figure 3:
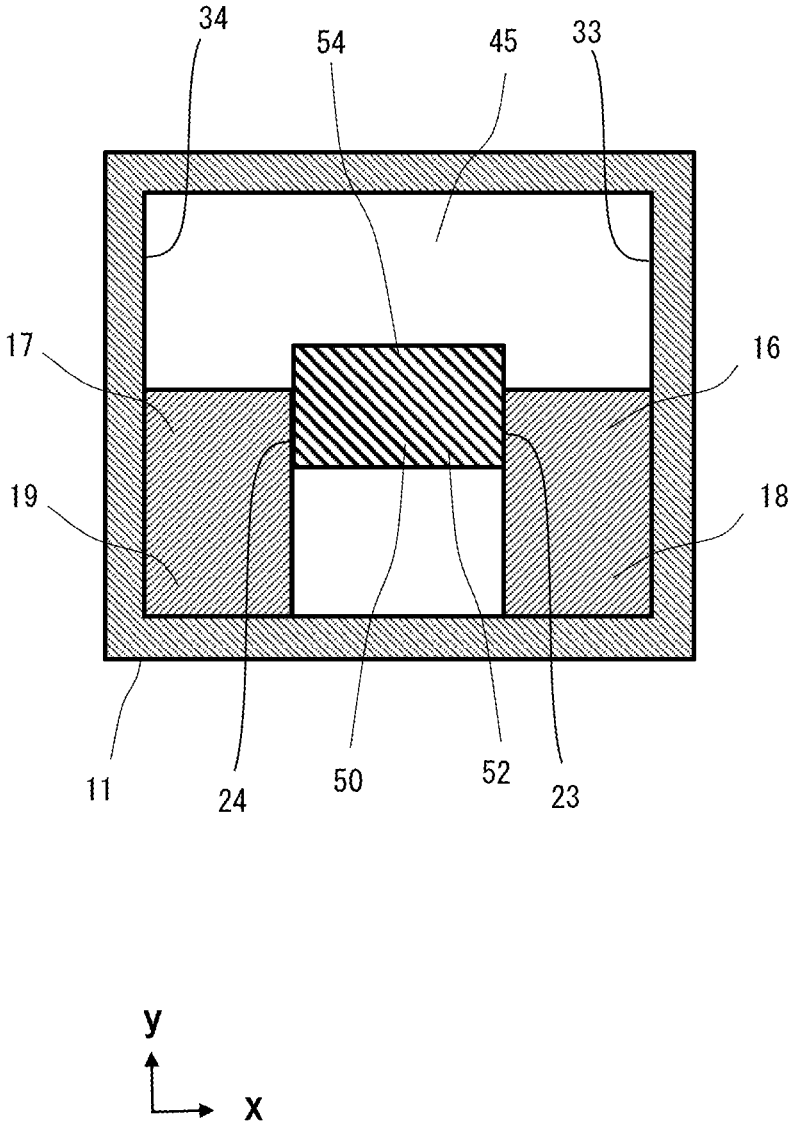
FIG. 3 is a cross-sectional view taken along the line B-B' of FIG. 1.
Figure 4:
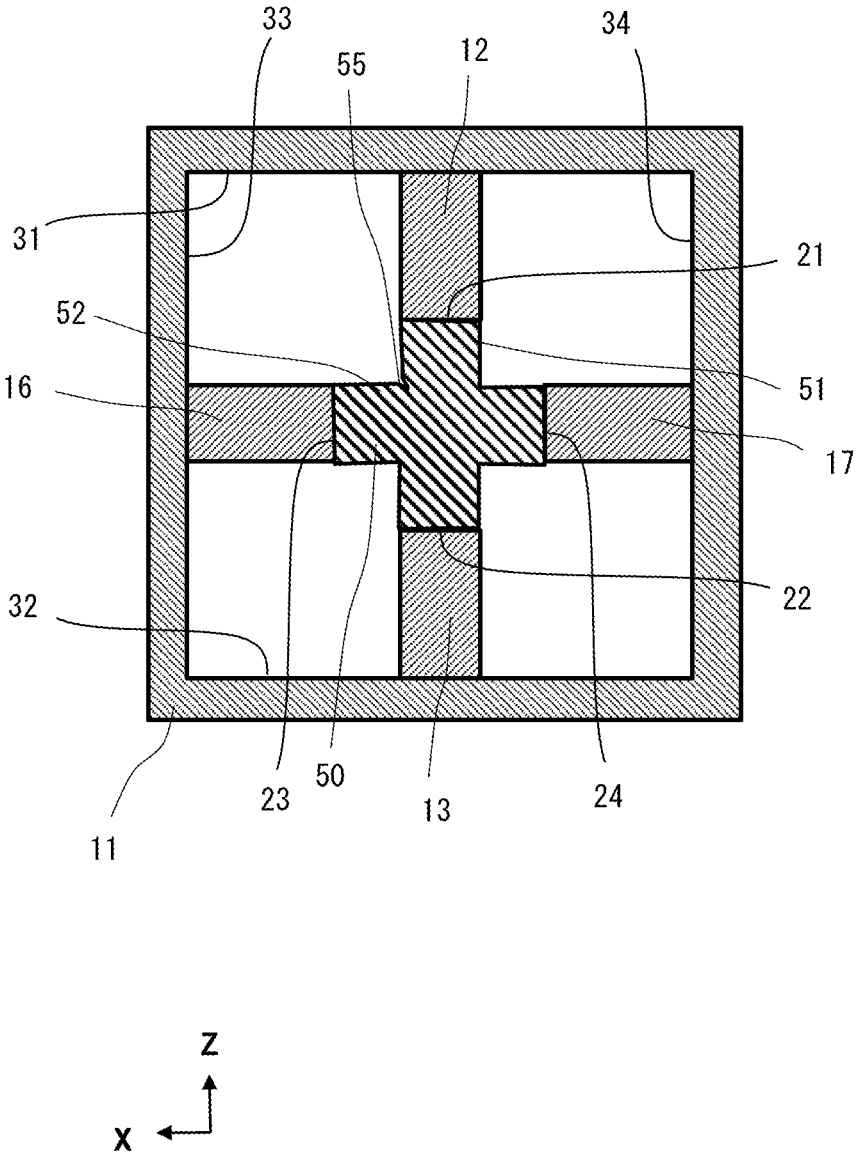
FIG. 4 is a cross-sectional view taken along the line C-C' of FIG. 1.

FIG. 1 is a schematic perspective view of a dielectric resonator according to a first embodiment of the invention. FIG. 2 is a cross-sectional view taken along the line A-A' (a diagram showing a cross-section (the cross-section dividing a conductor 11 into two equal parts in a +x direction) which is parallel to a yz plane including the line A-A' when seen from the +x direction) of FIG. 1. FIG. 3 is a cross-sectional view taken along the line B-B' (a diagram showing a cross-section (the cross-section dividing the conductor 11 into two equal parts in a +z direction) which is parallel to an xy plane including the line B-B' when seen from the +z direction) of FIG. 1. FIG. 4 is a cross-sectional view taken along the line C-C' (a diagram showing a cross-section (the cross-section dividing the conductor 11 into two equal parts in a +y direction) which is parallel to an xz plane including the line C-C' when seen from the +y direction) of FIG. 1. Meanwhile, in order to simplify the understanding of the structure, the conductor 11 is represented in a see-through manner in FIG. 1.

The dielectric resonator of the present embodiment includes a dielectric body 50, the conductor 11, a conductor 12, a conductor 13, a conductor 14, a conductor 15, a conductor 16, a conductor 17, a conductor 18, and a conductor 19 as illustrated in FIGS. 1 to 4.

The dielectric body 50 has a shape in which a first portion 51 and a second portion 52 cross each other. The first portion 51 is a columnar portion extending in a first direction (+z direction), and includes a surface 21 located at an end in the first direction (+z direction) of the first portion 51 and a surface 22 located at an end in a second direction (−z direction) opposite to the first direction of the first portion 51. The second portion 52 is a columnar portion extending in a third direction (+x direction) perpendicular to the first direction, and includes a surface 23 located at an end in the third direction (+x direction) of the second portion 52 and a surface 24 located at an end in a fourth direction (−x direction) opposite to the third direction of the second portion 52.

A known dielectric material such as dielectric ceramics can be used as a material of the dielectric body 50. For example, it is possible to suitably use a dielectric ceramic material containing $BaTiO_3$, $Pb_4Fe_2Nb_2O_{12}$, $TiO_2$, or the like. In some cases, it is possible to use a resin such as an epoxy resin. Meanwhile, in the present embodiment, a case where the first portion 51 and the second portion 52 are quadrangular prisms is described, but the first and second portions may have any of other shapes such as a hexagonal prism shape or a cylinder.

The conductor 11 has the form of a cuboid-shaped box. In addition, the conductor 11 is configured such that the dielectric body 50 is housed in a cavity 45 formed therein, and is disposed so as to surround the dielectric body 50 leaving space therefrom. In addition, the conductor 11 includes an inner surface 31 facing the surface 21 of the dielectric body 50, an inner surface 32 facing the surface 22 of the dielectric body 50, an inner surface 33 facing the surface 23 of the dielectric body 50, and an inner surface 34 facing the surface 24 of the dielectric body 50. Meanwhile, in the present embodiment, a case where the conductor 11 has an external shape of a cuboid is described, but the conductor may have any of other shapes such as a sphere or a dodecahedron.

The conductor 12 is a columnar conductor extending in the +z direction. In addition, the conductor 12 is provided on the surface 21 of the dielectric body 50. An end of the conductor 12 in the first direction (+z direction) is joined to or comes into contact with the inner surface 31 of the conductor 11 so as to be electrically connected to the inner surface 31 of the conductor 11.

The conductor 13 is a columnar conductor extending in the +z direction. In addition, the conductor 13 is provided on the surface 22 of the dielectric body 50. An end of the conductor 13 in the second direction (−z direction) is joined to or comes into contact with the inner surface 32 of the conductor 11 so as to be electrically connected to the inner surface 32 of the conductor 11.

The conductor 14 has a shape of a cuboid. In addition, the conductor 14 is disposed between the conductor 12 and the conductor 11 in a fifth direction (+y direction) perpendicular to the first direction and the third direction. An end of the conductor 14 in the fifth direction (+y direction) is joined to or comes into contact with the conductor 11 so as to be electrically connected to the conductor 11. An end of the conductor 14 in a direction (−y direction) opposite to the fifth direction is joined to or comes into contact with the conductor 12 so as to be electrically connected to the conductor 12. An end of the conductor 14 in the first direction (+z direction) is joined to or comes into contact with the inner surface 31 of the conductor 11 so as to be electrically connected to the conductor 11.

The conductor 15 has a shape of a cuboid. In addition, the conductor 15 is disposed between the conductor 13 and the conductor 11 in the fifth direction (+y direction). An end of the conductor 15 in the fifth direction (+y direction) is joined to or comes into contact with the conductor 11 so as to be electrically connected to the conductor 11. An end of the conductor 15 in a direction (−y direction) is opposite to the fifth direction is joined to or comes into contact with the conductor 13 so as to be electrically connected to the conductor 13. An end of the conductor 15 in the second direction (−z direction) is joined to or comes into contact with the inner surface 32 of the conductor 11 so as to be electrically connected to the conductor 11.

The conductor 16 is a columnar conductor extending in the +x direction. In addition, the conductor 16 is provided on the surface 23 of the dielectric body 50. An end of the conductor 16 in the third direction (+x direction) is joined to or comes into contact with the inner surface 33 of the conductor 11 so as to be electrically connected to the inner surface 33 of the conductor 11. An end of the conductor 16 in the fourth direction (−x direction) is joined to or comes into contact with the surface 23 of the dielectric body 50.

The conductor 17 is a columnar conductor extending in the +x direction. In addition, the conductor 17 is provided on the surface 24 of the dielectric body 50. In addition, an end of the conductor 17 in the fourth direction (−x direction) is joined to or comes into contact with the inner surface 34 of the conductor 11 so as to be electrically connected to the inner surface 34 of the conductor 11.

The conductor 18 has a shape of a cuboid. In addition, the conductor 18 is disposed between the conductor 16 and the conductor 11 in a sixth direction (−y direction) perpendicular to the first direction and the third direction. In addition, an end of the conductor 18 in the sixth direction (−y direction) is joined to or comes into contact with the conductor 11 so as to be electrically connected to the conductor 11. In addition, an end of the conductor 18 in a direction (+y direction) opposite to the sixth direction is joined to or comes into contact with the conductor 16 so as to be electrically connected to the conductor 16. An end of the conductor 18 in the third direction (+x direction) is joined to or comes into contact with the inner surface 33 of the conductor 11 so as to be electrically connected to the inner surface 33 of the conductor 11.

The conductor 19 has a shape of a cuboid. In addition, the conductor 19 is disposed between the conductor 17 and the conductor 11 in the sixth direction (−y direction). In addition, an end of the conductor 19 in the sixth direction (−y direction) is joined to or comes into contact with the conductor 11 so as to be electrically connected to the conductor 11. In addition, an end of the conductor 19 in a direction (+y direction) opposite to the sixth direction is joined to or comes into contact with the conductor 17 so as to be electrically connected to the conductor 17. In addition, an end of the conductor 19 in the fourth direction (−x direction) is joined to or comes into contact with the inner surface 34 of the conductor 11 so as to be electrically connected to the inner surface 34 of the conductor 11.

In addition, the dielectric body 50 includes a third portion 53 and a fourth portion 54. The third portion 53 is a portion of the first portion 51 which is not interposed between the conductor 12 and the conductor 13, and is located on a side of a direction (−y direction) opposite to the fifth direction of the first portion 51. In addition, the fourth portion 54 is a portion of the second portion 52 which is not interposed between the conductor 16 and the conductor 17, and is located on a side of a direction (+y direction) opposite to the sixth direction of the second portion 52.

In addition, as illustrated in FIG. 4, a groove 55 is formed in the dielectric body 50. The groove 55 is formed in a portion in which the first portion 51 and the second portion 52 intersect each other, and is formed throughout the entirety in the +y direction. The groove 55 has a function of removing the degeneracy of two resonance modes, and the shape of the groove 55 is appropriately adjusted in accordance with desired characteristics thereof.

Meanwhile, in the present embodiment, a case where the conductor 12, the conductor 13, the conductor 16, and the conductor 17 are quadrangular prisms is described, but the conductors may have any of other shapes such as a hexagonal prism or a cylinder. Here, it is desired that cross-sectional shapes of the conductor 12 and the conductor 13 when the conductors are cut off by a plane perpendicular to the +z direction are the same as that of a portion other than the third portion 53 of the first portion 51. In addition, it is desired that cross-sectional shapes of the conductor 16 and the conductor 17 when the conductors are cut off by a plane perpendicular to the +x direction are the same as that of a portion other than the fourth portion 54 of the second portion 52.

In addition, regarding portions of the conductors 11 to 19 (the conductor 11, the conductor 12, the conductor 13, the conductor 14, the conductor 15, the conductor 16, the conductor 17, the conductor 18, and the conductor 19) which come into contact with each other, the portions may electrically come into contact with each other, but it is desired that the portions are joined to each other in terms of reliability. In a case where the portions are joined to each other, the portions are required to be joined to each other so as to allow electrical conduction therebetween, and thus the portions may be joined to each other using soldering or a conductive adhesive or may be joined to each other using a screw, a bolt, or the like. In addition, all or some of the conductors 11 to 19 may be integrally formed. In addition, all or some of the conductors 11 to 19 may be formed by a plurality of components. Meanwhile, FIGS. 1 to 4 illustrate a case where the conductor 12 and the conductor 14 are integrally formed, the conductor 13 and the conductor 15 are integrally formed, the conductor 16 and the conductor 18 are integrally formed, and the conductor 17 and the conductor 19 are integrally formed.

In addition, regarding a contact portion between the dielectric body 50 and each of the conductor 12, the conductor 13, the conductor 16, and the conductor 17, the contact portion and the conductor may electrically come into contact with each other, but it is desired that the contact portion and the conductor are joined to each other in terms of reliability. The dielectric body 50 and each of the conductor 12, the conductor 13, the conductor 16, and the conductor 17 can be joined to each other using, for example, a conductive adhesive.

In addition, for example, a first plate-shaped conductor may be baked on the surface 21 of the dielectric body 50, a second plate-shaped conductor may be baked on the surface 22 of the dielectric body 50, a third plate-shaped conductor may be baked on the surface 23 of the dielectric body 50, a fourth plate-shaped conductor may be baked on the surface 24 of the dielectric body 50, a first columnar conductor may be joined to the first plate-shaped conductor by soldering or the like, a second columnar conductor may be joined to the second plate-shaped conductor by soldering or the like, a third columnar conductor may be joined to the third plate-shaped conductor by soldering or the like, and a fourth columnar conductor may be joined to the fourth plate-shaped conductor by soldering or the like. In this case, a complex of the first plate-shaped conductor and the first columnar conductor is equivalent to the conductor 12 in the present embodiment, a complex of the second plate-shaped conductor and the second columnar conductor is equivalent to the conductor 13 in the present embodiment, a complex of the third plate-shaped conductor and the third columnar conductor is equivalent to the conductor 16 in the present embodiment, and a complex of the fourth plate-shaped conductor and the fourth columnar conductor is equivalent to the conductor 17 in the present embodiment.

The conductors 11 to 19 can be formed of any of various known conductive materials such as a metal or a nonmetallic conductive material. However, in order to improve characteristics of the dielectric resonator, it is desired that, for example, a conductive material mainly containing an Ag alloy such as Ag, Ag—Pd, or Ag—Pt, a Cu-based, W-based, Mo-based, or Pd-based conductive material, or the like is used.

Meanwhile, the cavity 45 is filled with air. However, the inside of the cavity may be in a vacuum state, or the cavity may be filled with gas other than air.

In the dielectric resonator according to the present embodiment which has such a configuration, the dielectric body 50 includes the third portion 53 which is the portion of the first portion 51 which is not interposed between the conductor 12 and the conductor 13 and the fourth portion 54 which is the portion of the second portion 52 which is not interposed between the conductor 16 and the conductor 17. Thereby, it is possible to increase the volume of the dielectric body 50 while suppressing an increase in the volume of a region of the first portion 51 interposed between the conductor 12 and the conductor 13 and the volume of a region of the second portion 52 interposed between the conductor 16 and the conductor 17. Thereby, it is possible to reduce a resonant frequency in a third resonance mode while suppressing a reduction in resonant frequency in a first resonance mode and a second resonance mode. Thereby, the resonant frequency in the third resonance mode can be brought close to the resonant frequency in the first resonance mode and the resonant frequency in the second resonance mode so as to function as a triple mode resonator. In this manner, it is possible to obtain the triple mode resonator which has a simple structure and is easy to manufacture. Meanwhile, the first resonance mode and the second resonance mode are modes in which an electric field directed in the +z direction or the −z direction is generated inside the first portion 51 and an electric field directed in the +x direction or the −x direction is generated inside the second portion 52, and the third resonance mode is a mode in which an electric field directed in the +y direction or the −y direction is generated inside the dielectric body 50.

In addition, the dielectric resonator of the present embodiment can increase a resonant frequency in a spurious mode having the lowest resonant frequency as compared with a dielectric resonator of the related art which does not include the conductors 12 to 19 as disclosed in Patent Literature 1, and thus it is possible to obtain the dielectric resonator with satisfactory electrical characteristics which has a wide gap between a resonant frequency in a fundamental mode and a resonant frequency in a spurious mode. Meanwhile, the dielectric resonator of the present embodiment is different from a dielectric resonator of the related art in a spurious mode having the lowest resonant frequency, and it is considered that these effects have been obtained by a change in resonance mode.

In addition, the dielectric resonator of the present embodiment includes the conductor 14 and the conductor 15, and thus it is possible to increase a Q value in resonance in a fundamental mode, as compared with a case where the dielectric resonator does not include the conductor 14 and the conductor 15. In a case where the dielectric resonator does not include the conductor 14 and the conductor 15, a current loss occurs in the conductor 12 and the conductor 13 due to a magnetic field which is generated so as to surround each of the conductor 12 and the conductor 13, and this action results in a reduction in a Q value. In the dielectric resonator of the present embodiment, a magnetic field which is generated so as to surround each of the conductor 12 and the conductor 13 can be reduced by the conductor 14 and the conductor 15, and thus it is supposed that a Q value is improved by a reduction in a current loss in the conductor 12 and the conductor 13.

Similarly, the dielectric resonator of the present embodiment includes the conductor 18 and the conductor 19, and thus it is possible to increase a Q value in resonance in a fundamental mode, as compared with a case where the dielectric resonator does not include the conductor 18 and the conductor 19. In a case where the dielectric resonator does not include the conductor 18 and the conductor 19, a current loss occurs in the conductor 16 and the conductor 17 due to a magnetic field which is generated so as to surround each of the conductor 16 and the conductor 17, and this action results in a reduction in a Q value. In the dielectric resonator of the present embodiment, a magnetic field which is generated so as to surround each of the conductor 16 and the conductor 17 can be reduced by the conductor 18 and the conductor 19, and thus it is supposed that a Q value is improved by a reduction in a current loss in the conductor 16 and the conductor 17.

Meanwhile, as illustrated in FIGS. 1 and 2, it is desired that the conductor 14 is located between the conductor 12 and the conductor 11 on a side of the fifth direction (+y direction) with respect to the conductor 12 and lies throughout the entirety of a region located between the surface 21 and the inner surface 31 in the first direction (+z direction). In addition, it is desired that the conductor 15 is located between the conductor 13 and the conductor 11 on a side of the fifth direction (+y direction) with respect to the conductor 13 and lies throughout the entirety of a region located between the surface 22 and the inner surface 32 in the first direction (+z direction). Thereby, a magnetic field generated so as to surround each of the conductor 12 and the conductor 13 can be further reduced, and thus it is possible to further reduce a current loss in the conductor 12 and the conductor 13 and to further improve a Q value.

In addition, as illustrated in FIGS. 1 and 3, it is desired that the conductor 18 is located between the conductor 16 and the conductor 11 on a side of the sixth direction (−y direction) with respect to the conductor 16 and lies throughout the entirety of a region located between the surface 23 and the inner surface 33 in the third direction (+x direction). In addition, it is desired that the conductor 19 is located between the conductor 17 and the conductor 11 on a side of the sixth direction (−y direction) with respect to the conductor 17 and lies throughout the entirety of a region located between the surface 24 and the inner surface 34 in the third direction (+x direction). Thereby, a magnetic field generated so as to surround each of the conductor 16 and the conductor 17 can be further reduced, and thus it is possible to further reduce a current loss in the conductor 16 and the conductor 17 and to further improve a Q value.

In addition, in the dielectric resonator of the present embodiment, the fifth direction (+y direction) and the sixth direction (−y direction) are opposite directions to each other. That is, a direction in which the conductor 14 and the conductor 15 are located with respect to the conductor 12 and the conductor 13 and a direction in which the conductor 18 and the conductor 19 are located with respect to the conductor 16 and the conductor 17 are opposite to each other. Thereby, it is possible to prevent electrical characteristics from deteriorating due to a reduction in symmetry of electromagnetic field distribution and to obtain a dielectric resonator facilitating electromagnetic coupling.

Second Embodiment

Figure 5:
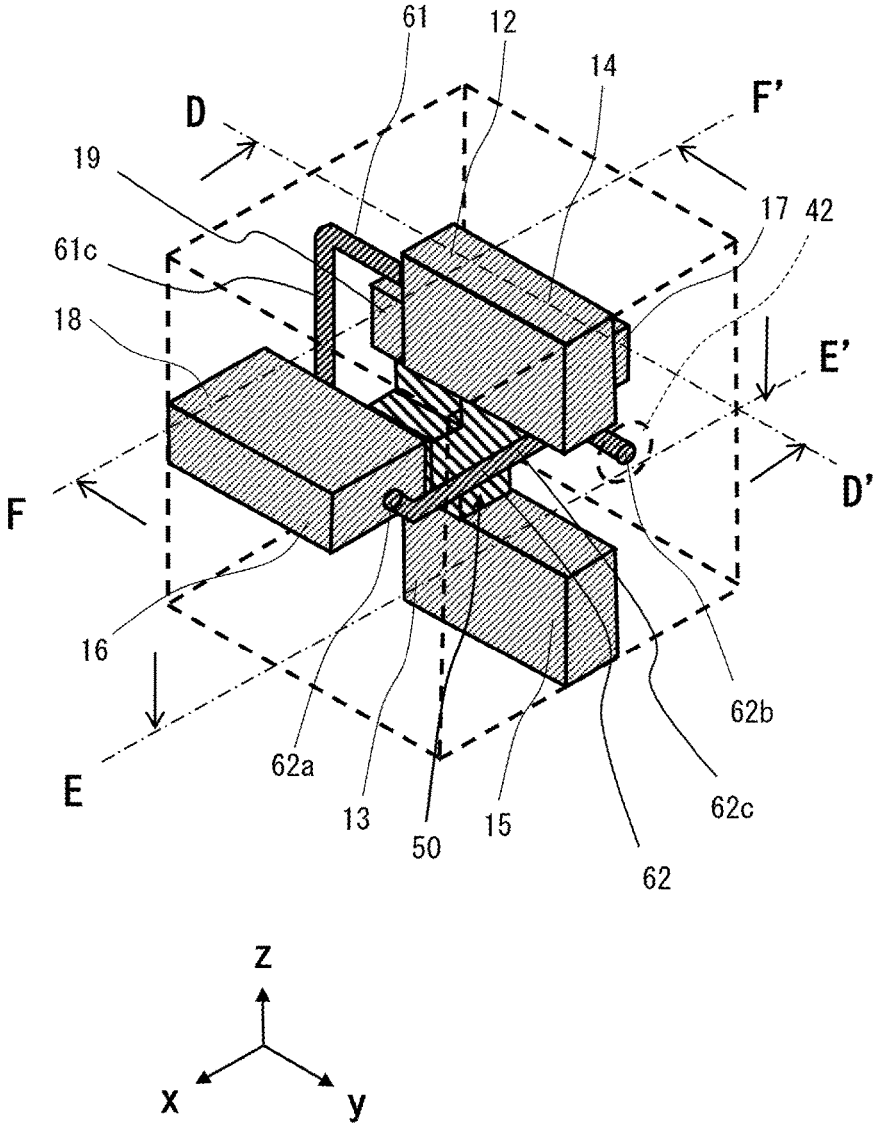
FIG. 5 is a schematic perspective view of a dielectric filter according to a second embodiment of the invention.
Figure 6:
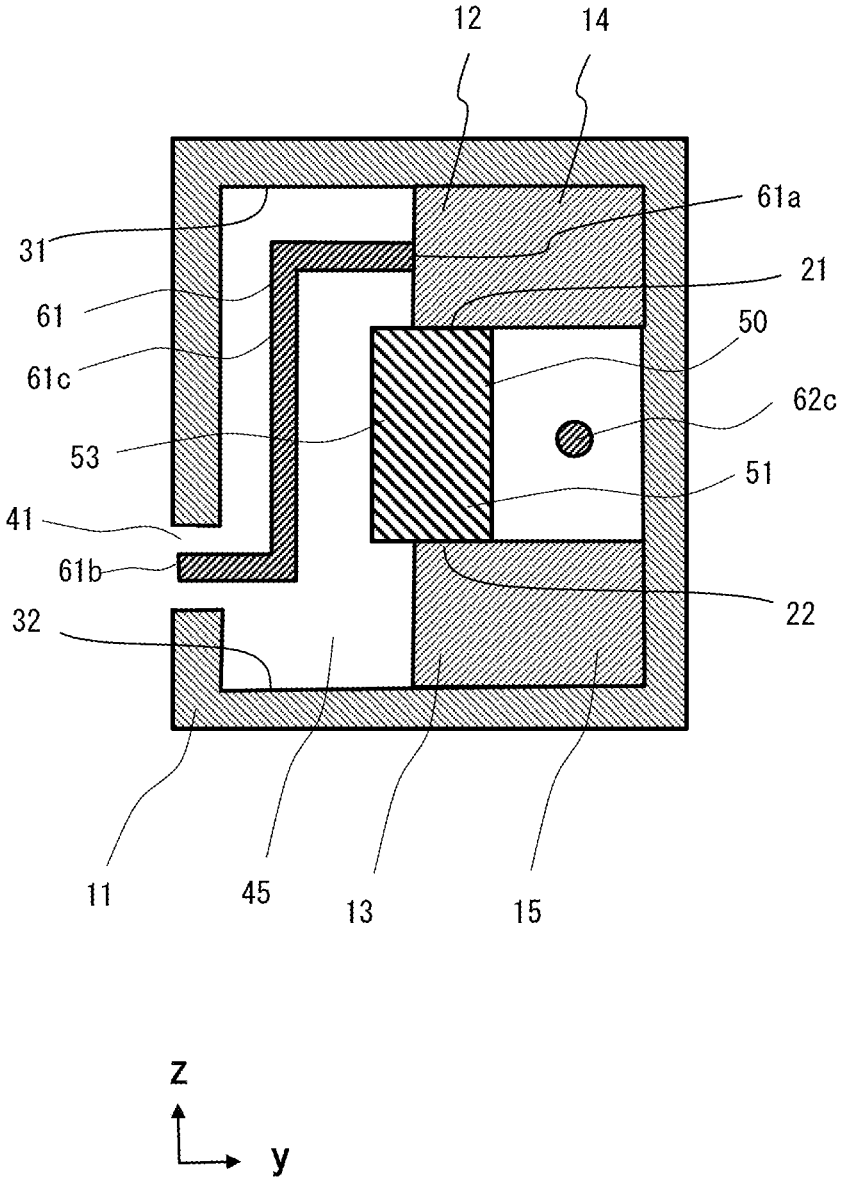
FIG. 6 is a cross-sectional view taken along the line D-D' of FIG. 5.
Figure 7:
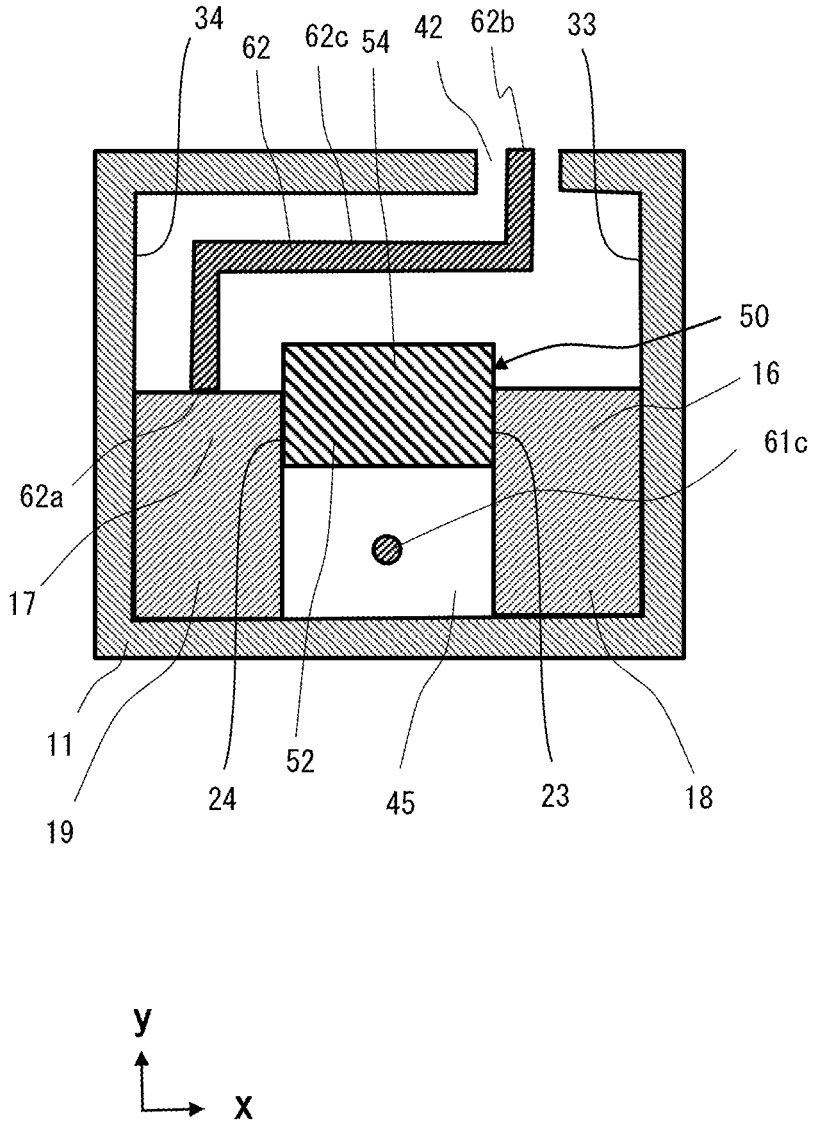
FIG. 7 is a cross-sectional view taken along the line E-E' of FIG. 5.
Figure 8:
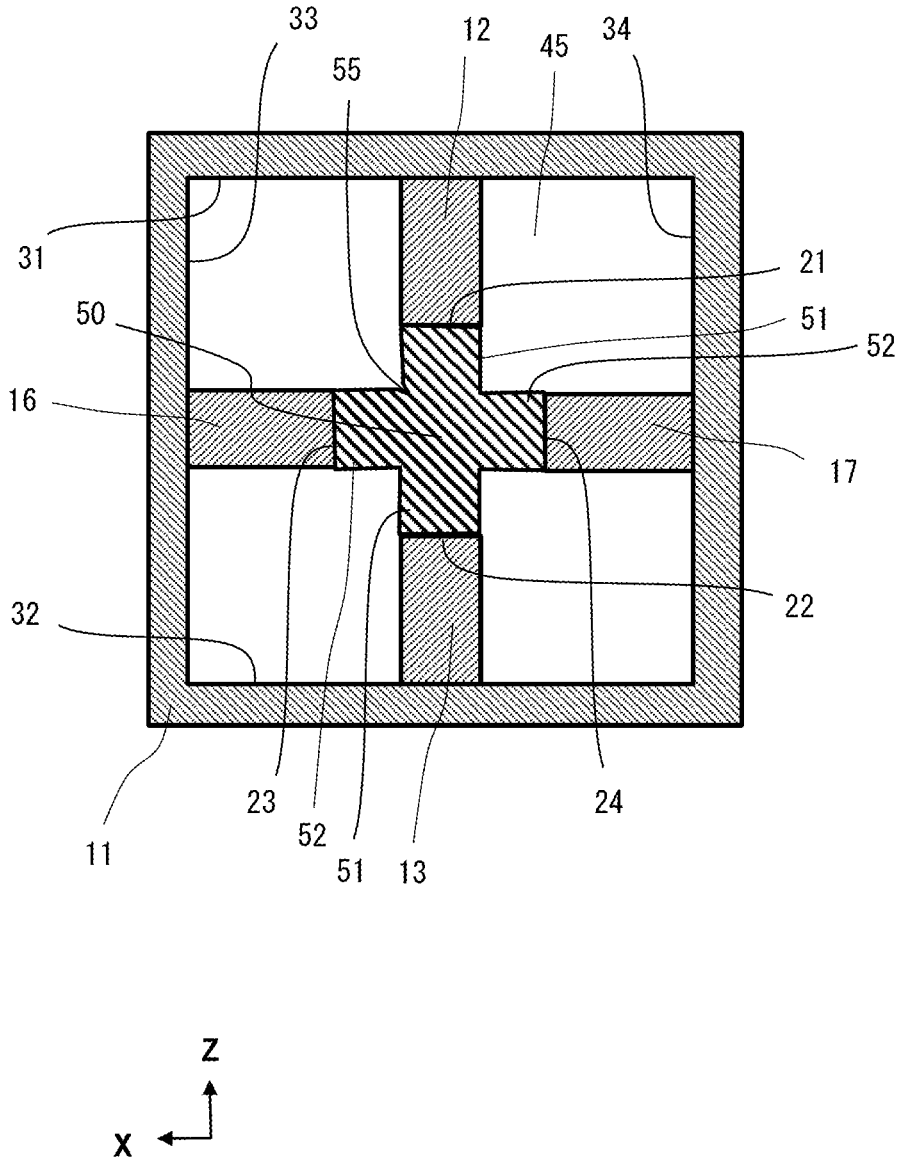
FIG. 8 is a cross-sectional view taken along the line F-F' of FIG. 5.

FIG. 5 is a schematic perspective view of a dielectric filter according to a second embodiment of the invention. FIG. 6 is a cross-sectional view taken along the line D-D' (a diagram showing a cross-section (the cross-section dividing the conductor 11 into two equal parts in the x direction) which is parallel to a yz plane including the line D-D' when seen from the +x direction) of FIG. 5. FIG. 7 is a cross-sectional view taken along the line E-E' (a diagram showing a cross-section (the cross-section dividing the conductor 11 into two equal parts in the +z direction) which is parallel to an xy plane including the line E-E' when seen from the +z direction) of FIG. 5. FIG. 8 is a cross-sectional view taken along the line F-F' (a diagram showing a cross-section (the cross-section dividing the conductor 11 into two equal parts in the +y direction) which is parallel to an xz plane including the line F-F' when seen from the +y direction) of FIG. 5. Meanwhile, in order to simplify the understanding of the structure, the conductor 11 is represented in a see-through manner in FIG. 5. In addition, in the present embodiment, portions different from those in the above-described first embodiment will be described, and the same components will be denoted by the same reference numerals and signs, and thus a repeated description will be omitted. As illustrated in FIGS. 5 to 8, the dielectric filter of the present embodiment includes the dielectric resonator of the above-described first embodiment, a conductor 61, and a conductor 62.

The conductor 61 is a linear conductor, and includes an end 61*a* which is one end, an end 61*b* which is the other end, and a coupling portion 61*c* which is a portion extending in the first direction (+z direction) along the first portion 51. The coupling portion 61*c* is a portion which is coupled to the first portion 51 mainly via a magnetic field. In addition, the end 61*a* is connected to the conductor 12, and the end 61*b* is exposed to the outside through a through hole 41 formed in the conductor 11. Meanwhile, the end 61*a* may be connected to the conductor 13 instead of the conductor 12. In this manner, the conductor 61 is electromagnetically coupled to the first portion 51.

The conductor 62 is a linear conductor, and includes an end 62*a* which is one end, an end 62*b* which is the other end, and a coupling portion 62*c* which is a portion extending in the third direction (+x direction) along the second portion 52. The coupling portion 62*c* is a portion which is coupled to the second portion 52 mainly via a magnetic field. In addition, the end 62*a* is connected to the conductor 16, and the end 62*b* is exposed to the outside through a through hole 42 formed in the conductor 11. Meanwhile, the end 62*a* may be connected to the conductor 17 instead of the conductor 16. In this manner, the conductor 62 is electromagnetically coupled to the second portion 52.

Meanwhile, it is desired that the coupling portion 61*c* is formed in parallel to the +z direction, but the coupling portion 61*c* may be inclined with respect to the +z direction as long as it includes a +z direction component. Similarly, it is desired that the coupling portion 62*c* is formed in parallel to the +x direction, but the coupling portion 62*c* may be inclined with respect to the +x direction as long as it includes a +x direction component. In addition, the positions and lengths of the coupling portion 61*c* and the coupling portion 62*c* can be appropriately adjusted depending on the magnitude of desired magnetic field coupling.

In the dielectric filter of the present embodiment which has such a configuration, for example, when an electrical signal is inputted from the end 61*b* of the conductor 61, the dielectric body 50 resonates, and an electrical signal is outputted from the end 62*b* of the conductor 62. At this time, a signal of a frequency band including resonant frequencies in the above-described first resonance mode, second resonance mode, and third resonance mode selectively passes through the dielectric filter, and thus the dielectric filter functions as a band pass filter.

The dielectric filter of the present embodiment constitutes a filter using the dielectric resonator of the first embodiment which has a simple structure and is easy to manufacture. Thereby, it is possible to obtain a dielectric filter which has a simple structure and is easy to manufacture. In addition, the dielectric filter of the present embodiment has a high Q value in resonance in a fundamental mode and has a wide gap between a resonant frequency in a fundamental mode and a resonant frequency in a spurious mode, and thus the dielectric filter constitutes a filter using the dielectric resonator of the first embodiment which has satisfactory electrical characteristics. Thereby, it is possible to obtain a dielectric filter with excellent electrical characteristics which has a small insertion loss in a pass band and a large attenuation in the vicinity of the pass band.

Third Embodiment

Figure 9:
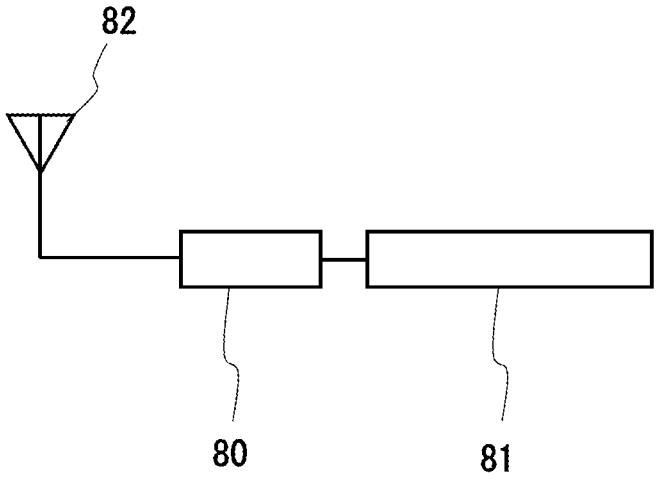
FIG. 9 is a schematic block diagram of a communication apparatus according to a third embodiment of the invention.

FIG. 9 is a schematic block diagram of a communication apparatus according to a third embodiment of the invention. The communication apparatus of the present embodiment includes an antenna 82, a communication circuit 81, and a dielectric filter 80 configured to connect the antenna 82 with the communication circuit 81. The dielectric filter 80 is the dielectric filter according to the above-described second embodiment. The antenna 82 and the communication circuit 81 are a known antenna and communication circuit of the related art.

The communication apparatus of the present embodiment having such a configuration removes unnecessary electrical signals using the dielectric filter of the second embodiment which has a simple structure and is easy to manufacture, and thus it is possible to obtain a communication apparatus which is easy to manufacture.

EXAMPLE

First Example

Electrical characteristics of the dielectric resonator of the first embodiment illustrated in FIGS. 1 to 4 were calculated by simulation. In the simulation, a dielectric body constituting the dielectric body 50 had a relative permittivity which was set to 60 and a dielectric loss tangent which was set to 0.00005. The conductivity of each of the conductors 11 to 19 was set to $46.4\times10^6$ S/m. The inside of the conductor 11 (external shape of the cavity 45) was configured to have a shape of a cuboid in which a dimension in the +x direction was 24 mm, a dimension in the +y direction was 24 mm, and a dimension in the +z direction was 20 mm, and the dielectric body 50 was disposed at the center of the cavity 45. Each of the first portion 51 and the second portion 52 was configured to have a shape of a quadrangular prism in which dimensions of three orthogonal directions were 3.7 mm, 5.7 mm, and 10 mm. The dielectric 50 was configured to have a shape in which the first portion 51 and the second portion 52 crossed each other at their respective centers. The conductor 12, the conductor 13, the conductor 16, and the conductor 17 were configured as quadrangular prisms in which dimensions of three orthogonal directions were 3.7 mm, 3.7 mm, and 5 mm. The conductor 14, the conductor 15, the conductor 18, and the conductor 19 were configured to have the same shape. As a result, resonant frequencies in three fundamental modes (a first resonance mode, a second resonance mode, and a third resonance mode) were 1.956 GHz, 1.973 GHz, and 2.058 GHz. In addition, a resonant frequency in the spurious mode having the lowest frequency was 5.035 GHz.

Figure 10:
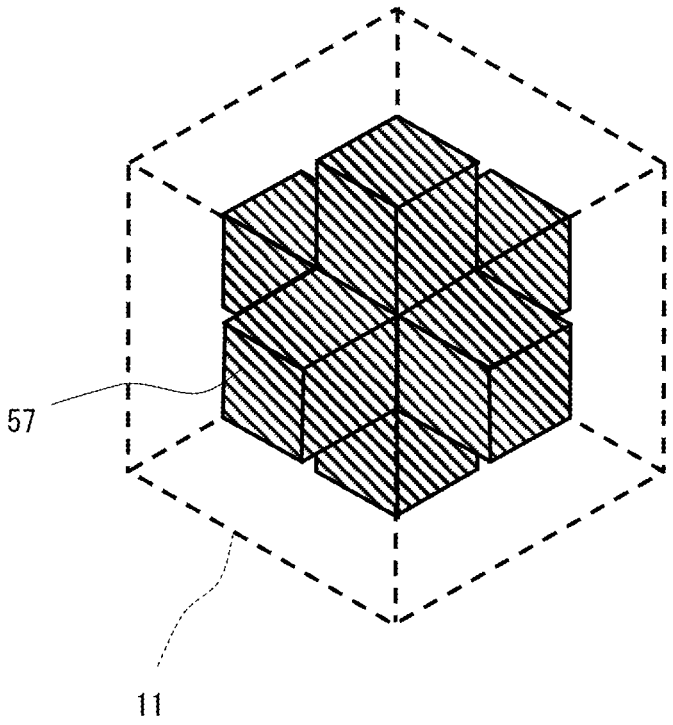
FIG. 10 is a schematic perspective view of a dielectric resonator according to a comparative example.

In addition, electrical characteristics of a dielectric resonator according to a comparative example illustrated in FIG. 10 were calculated by simulation. The dielectric resonator of the comparative example was configured to have a shape in which the dielectric resonator did not include the conductor 12, the conductor 13, the conductor 14, the conductor 15, the conductor 16, the conductor 17, the conductor 18, and the conductor 19, as illustrated in FIG. 10, and a dielectric body 57 was configured to have a shape in which three columnar dielectric bodies crossed each other at their respective centers. In addition, in order to make a resonant frequency in a fundamental mode substantially consistent with that of the dielectric resonator according to the first embodiment, three columnar dielectric bodies were configured to have a shape of a quadrangular prism in which dimensions of three orthogonal directions were 6 mm, 6 mm, and 20 mm. The inside of the conductor 11 (external shape of the cavity 45) was configured to have a shape of a cuboid in which a dimension in the +x direction was 20 mm, a dimension in the +y direction was 20 mm, and a dimension in the +z direction was 20 mm. As a result, resonant frequencies in three fundamental modes were 2.044 GHz, 2.045 GHz, and 2.050 GHz. In addition, a resonant frequency in the spurious mode having the lowest frequency was 2.546 GHz.

According to these results, in the dielectric resonator according to the first embodiment, it is possible to drastically increase a resonant frequency in a spurious mode having the lowest frequency, as compared to the dielectric resonator according to the comparative example which is a dielectric resonator of the related art, and thus it can be understood that it is possible to secure a wide gap between a resonant frequency in a fundamental mode and a resonant frequency in a spurious mode. Thereby, effectiveness of the invention can have been confirmed.

Second Example

Figure 11:
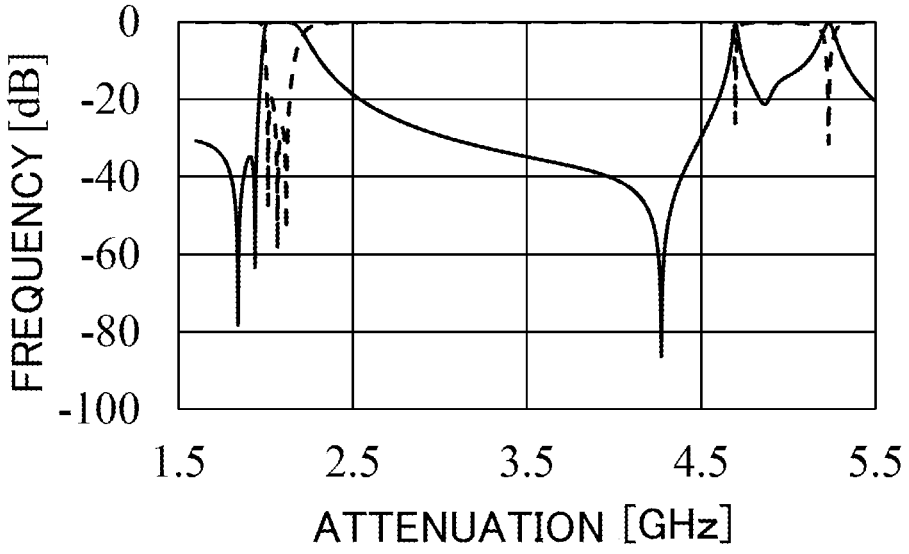
FIG. 11 is a graph showing simulation results for electrical characteristics of the dielectric filter according to the second embodiment of the invention.

In addition, electrical characteristics of the dielectric filter of the second embodiment illustrated in FIGS. 5 to 8 were calculated by simulation. In the simulation, a dielectric constituting the dielectric body 50 had a relative permittivity which was set to 60 and a dielectric loss tangent which was set to 0.00005. The dielectric body 50 was configured to have the same shape as that in the first example. The conductivity of each of the conductors 11 to 19, the conductor 61, and the conductor 62 was set to $46.4\times10^6$ S/m. Each of the conductors 11 to 19 was configured to have the same shape as that in the first example. The results thereof are shown in a graph of FIG. 11. In the graph, the abscissa axis represents a frequency, and the ordinate axis represents the attenuation. In addition, a solid line represents a transmission characteristic (S21), and a dashed line represents a reflection characteristic (S11). According to the graph, three peaks of S11 can be confirmed in a pass band in the vicinity of 2 GHz, and it can be understood that triple mode resonance occurs. In addition, according to the graph, it can be understood that excellent electrical characteristics that an insertion loss of a pass band is small and the attenuation in the vicinity of the pass band is large are obtained. Thereby, further effectiveness of the invention can have been confirmed.

REFERENCE SIGNS LIST

11, 12, 13, 14, 15, 16, 17, 18, 19, 61, 62: Conductor
41, 42: Through hole
45: Cavity
50, 57: Dielectric body
51: First portion
52: Second portion
53: Third portion
54: Fourth portion
80: Dielectric filter
81: Communication circuit
82: Antenna

The invention claimed is:

1. A dielectric resonator, comprising:
a dielectric body;
a first conductor;
a second conductor;
a third conductor;
a fourth conductor; and
a fifth conductor,
the dielectric body including
a first portion which has a first surface located at an end in a first direction of the first portion and a second surface located at an end in a second direction opposite to the first direction of the first portion, the first portion having a columnar shape, and
a second portion which has a third surface located at an end in a third direction perpendicular to the first direction of the second portion and a fourth surface located at an end in a fourth direction opposite to the third direction of the second portion, the second portion having a columnar shape,
the first portion and the second portion crossing each other,
the first conductor being disposed such that the dielectric body is housed in a cavity formed therein, the first conductor being disposed so as to surround the dielectric body leaving space therefrom, the first conductor having a first inner surface facing the first surface, a second inner surface facing the second surface, a third inner surface facing the third surface, and a fourth inner surface facing the fourth surface,
the second conductor being disposed on the first surface, an end in the first direction of the second conductor being electrically connected to the first inner surface,
the third conductor being disposed on the second surface, an end in the second direction of the third conductor being electrically connected to the second inner surface,
the fourth conductor being disposed on the third surface, an end in the third direction of fourth conductor being electrically connected to the third inner surface,
the fifth conductor being disposed on the fourth surface, an end in the fourth direction of the fifth conductor being electrically connected to the fourth inner surface,
the dielectric body including a third portion which is a portion of the first portion which is not interposed between the second conductor and the third conductor, and a fourth portion which is a portion of the second portion which is not interposed between the fourth conductor and the fifth conductor.

2. The dielectric resonator according to claim 1, further comprising:
a sixth conductor; and
a seventh conductor,
wherein the sixth conductor is disposed between the second conductor and the first conductor in a fifth direction perpendicular to the first direction and the third direction, of which an end in the fifth direction is electrically connected to the first conductor, of which an end in a direction opposite to the fifth direction is electrically connected to the second conductor, and of which an end in the first direction is electrically connected to the first inner surface, and
the seventh conductor is disposed between the third conductor and the first conductor in the fifth direction, of which an end in the fifth direction is electrically connected to the first conductor, of which an end in a direction opposite to the fifth direction is electrically connected to the third conductor, and of which an end in the second direction is electrically connected to the second inner surface.

3. The dielectric resonator according to claim 2, further comprising:

an eighth conductor; and a ninth conductor, wherein the eighth conductor is disposed between the fourth conductor and the first conductor in a sixth direction perpendicular to the first direction and the third direction, of which an end in the sixth direction is electrically connected to the first conductor, of which an end in a direction opposite to the sixth direction is electrically connected to the fourth conductor, and of which an end in the third direction is electrically connected to the third inner surface, and the ninth conductor is disposed between the fifth conductor and the first conductor in the sixth direction, of which an end in the sixth direction is electrically connected to the first conductor, of which an end in a direction opposite to the sixth direction is electrically connected to the fifth conductor, and of which an end in the fourth direction is electrically connected to the fourth inner surface.

4. The dielectric resonator according to claim 3, wherein the fifth direction and the sixth direction are opposite directions to each other.

5. A dielectric filter, comprising:

the dielectric resonator according to claim 1;

a tenth conductor; and an eleventh conductor, the tenth conductor being a linear conductor, and including a first end which is one end, and a second end which is the other end, the first end being connected to the second conductor or the third conductor, the second end being exposed to an outside through a first through hole provided in the first conductor, the tenth conductor being electromagnetically coupled to the first portion, the eleventh conductor being a linear conductor, and including a third end which is one end, and a fourth end which is the other end, the third end being connected to the fourth conductor or the fifth conductor, the fourth end being exposed to an outside through a second through hole provided in the first conductor, the eleventh conductor being electromagnetically coupled to the second portion.

6. A communication apparatus, comprising:

an antenna;

a communication circuit; and the dielectric filter according to claim 5, the dielectric filter being configured to connect the antenna with the communication circuit.

* * * * *